US007861351B2

(12) United States Patent
Ho

(10) Patent No.: US 7,861,351 B2
(45) Date of Patent: Jan. 4, 2011

(54) ELECTRIC CLEANING SWEEPER

(75) Inventor: Ka Nam Ho, Kowloon (HK)

(73) Assignee: Kwonnie Electrical Products Limited, Hong Kong (HK)

( * ) Notice: Subject to any disclaimer, the term of this patent is extended or adjusted under 35 U.S.C. 154(b) by 1165 days.

(21) Appl. No.: 11/300,622

(22) Filed: Dec. 14, 2005

(65) Prior Publication Data

US 2006/0242775 A1 Nov. 2, 2006

(30) Foreign Application Priority Data

Apr. 29, 2005 (CN) ..... 2005 1 0068523

(51) Int. Cl.
*A47L 11/24* (2006.01)
*A47L 11/33* (2006.01)
*A47L 11/32* (2006.01)

(52) U.S. Cl. ..... 15/41.1; 15/52.1

(58) Field of Classification Search ..... 15/41.1, 15/42, 144.1, 410, 403, 328, 353, 52.1, 78, 15/79.2, 79.1, 83; 294/65.5; D32/74; 285/43; 280/43.17; *A47L 11/24, 11/32, 11/33*
See application file for complete search history.

(56) References Cited

U.S. PATENT DOCUMENTS 1,442,587 A 1/1923 Steel
3,184,775 A 5/1965 Downey et al.
4,765,012 A 8/1988 Ueda
4,878,261 A * 11/1989 Rosendall ..... 15/41.1
5,224,232 A * 7/1993 Zahuranec et al. ..... 15/41.1
5,224,332 A 7/1993 Schwarz et al.
6,574,831 B2 * 6/2003 Hunter et al. ..... 15/410
6,968,587 B2 11/2005 Grey
7,152,267 B2 * 12/2006 Kaleta ..... 15/42
2004/0045126 A1 * 3/2004 Parker et al. ..... 15/403
2004/0181890 A1 * 9/2004 Roberson ..... 15/144.1
2004/0221406 A1 * 11/2004 Grey ..... 15/42
2005/0181968 A1 * 8/2005 Policicchio et al. ..... 510/438

FOREIGN PATENT DOCUMENTS

EP 100438 A2 * 2/1984
GB 1442587 7/1976
GB 1488852 10/1977

* cited by examiner

*Primary Examiner*—Monica S Carter
*Assistant Examiner*—Stephanie Newton
(74) *Attorney, Agent, or Firm*—Akerman Senterfitt

(57) ABSTRACT

An electric cleaning sweeper comprises a housing, including a detachable dirt tray placed inside the housing; and at least one openable wall located on the dirt tray wherein the openable wall is responsive to movement of a device located on the handle which can pick up the dirt tray and remove it off the housing to discharge the dust and debris while direct contact of the dirt tray by a human hand is avoided.

12 Claims, 15 Drawing Sheets

ELECTRIC CLEANING SWEEPER

FIELD OF THE INVENTION

This invention relates to an electric cleaning sweeper for surface cleaning such as on carpet, upholstery, or hard floor. The electric cleaning sweeper can include a removable dirt tray for collecting dust and debris, and a detachable handle to remove the dirt tray.

BACKGROUND OF THE INVENTION

A domestic sweepers is known as a surface cleaning apparatus which cleans the surface such as hard floor or carpet by means of a rotating brush bar. When the domestic sweeper is under normal use, the brush bar rotates and contacts the surface being cleaned, thus the dust or debris on the cleaning surface can be collected. The rotating brush bar is generally driven by friction means or electric means. The friction driven sweepers have at least one friction activator which contacts with the cleaning surface. A friction means sweeper is known, for example, from GB 1488852, in which a rotatable brush of the carpet sweeper is driven by drive means from a drive wheel. When the sweeper moves forward or backward, a friction activator engages with the cleaning surface, thereafter the brush bar rotates to clean the surface. A problem with this type of sweeper is that the sweeping power is highly dependent on the frictional force which is generated between the friction activator and the cleaning surface. The result is that the sweeping power decreases as the frictional force is reduced or the brush roller stops when there is no friction.

An improved sweeper is known, for example, from GB 1442587, and uses electricity to drive the brush bar by a motor. The major improvement is that the electricity driven sweeper can work on any surface independently of friction between the cleaning surfaces. In addition, the sweeping power can be increased easily by adjusting the motor speed. The motor is powered either by mains electricity supply or battery pack, which may be rechargeable. When the sweeper is powered by mains electricity supply, runtime can be relatively long, but the sweeping area is restricted by the power supply connection. In the purpose of increasing the mobility of sweeper, most of the portable sweepers use a rechargeable battery pack instead of mains electricity supply as the power source.

Most known sweepers provide handle means such that a user can control the movement of the sweeper through the handle means. The handle means typically connect with the main housing of a sweeper with a joint, which allows the user to control the sweeping movement manually. The distance between the handle means and the main housing is predetermined by the manufacturers or users in according to the cleaning purpose.

Generally, both friction means and electric means sweepers contain at least one dirt container, which functions to collect dust and debris when the sweeper is under normal use. The dirt container may be embodied as dust chamber or dirt tray, which is generally located inside the housing or forms as a portion of housing. When the sweeper is operating, dirt is generally collected nearby the brush bar. Therefore, the most efficient dirt tray location of sweeper is normally adjacent to the brush bar. For example, sweepers as described in U.S. Pat. No. 3,184,775 and U.S. Pat. No. 4,765,012 are both equipped with a dirt tray adjacent to the brush bar in order to collect swept materials.

The second function of a dirt tray is to facilitate emptying of dirt from the sweeper. It is essential that the design of the dirt tray allows user to empty the swept materials, otherwise, the newly collected dust may leak out when the dirt tray is filled. For some historical sweepers, in order to reduce the manufacturing cost, the housing is used as the dirt tray for collecting. However, once this kind of dirt collector is filled, the whole sweeper needed to be cleaned, which is very inconvenient for the user.

The known dirt trays for sweepers, for example from U.S. Pat. No. 1,442,587 are designed to be movable or removable to extend the freedom of cleaning for the dirt tray. The drawback of this type is that user usually needs to contact the dirt tray by their hand in order to move or remove the dirt tray. The dirt may thus smear users hands, and thereafter cause hygiene problems. Furthermore, some moveable or removable dirt tray that are similar to U.S. Pat. No. 5,224,332, do not have any cover intended to seal the dirt collected therein, and thus dirt may spread and be dispersed around the surrounding area. It is undesirable that the typical dirt collector in sweeper always brings lots of functional problems and hygienic problems.

In accordance with the present invention of a dirt tray and designated dirt collector removal method, it intended to provide a more convenient and hygienic means to empty and clean the dirt tray.

SUMMARY OF THE INVENTION

It is therefore an object of the present invention to provide a surface cleaning sweeper including a setting comprising of a detachable dirt tray attachable to a detachable handle, which is to improve the efficiency of a cleaning sweeper of the type in the foregoing referred to, so as to overcome or at least ameliorate the aforementioned problems of the existing known cleaning sweepers in dealing with the removal of the dust and dirt collected in the sweeper.

According to a first preferred embodiment of the present invention there is provided an electric sweeper comprising a detachable dirt tray and means responsive to movement of a button that is located on the upper housing of the electric sweeper for releasing the dirt tray lock so that the dirt tray can be detached from the housing. In this invention, the dirt tray is in connection with a handle by a pivot joint wherein the dirt tray can be detached by applying a gripping and a pulling force on the handle perpendicularly away from the upper surface of the housing after the dirt tray lock has been released. At least one openable wall exists on the dirt tray for providing a channel for the swept materials that accumulated inside the dirt tray compartment to be discharged. In a preferred embodiment, a means responsive to movement of a button that is positioned on the handle is used for opening an openable wall that exists on the dirt tray.

The handle which is connected with the dirt tray can comprise a lower handle and an detachable extendable handle. A user can adjust the length of the extendable handle, or simply only use the lower handle with the sweeper according to different operating conditions. The user can grip the lower handle for operation when the extendable handle is detached, or grip the extendable handle when it is equipped. The dirt tray may be locked inside the housing by at least one lock means which is responsive to the movement of a dirt tray release button that is located on the upper housing of the electric sweeper. Preferably, the user can step on the dirt tray release button to release the dirt tray lock means so that the dirt tray is no longer locked inside the housing. As the dirt tray is connected with the handle, user can detach the dirt tray from the housing by griping on the lower handle or the extendable handle for taking out the dirt tray. This eliminates the need for the user's hands to directly contact the dirt tray during the dirt tray detachment process.

In a preferred embodiment of the present invention the dirt tray is detachably positioned inside the housing of the electric sweeper. The pivot joint between the handle and the dirt tray becomes a connection point between the handle and the sweeper during operation, and this connection makes the dirt tray detaching process more convenient. The user may detach the dirt tray for removing the swept dust and debris after operating the sweeper. The present design of the connection between the handle and the dirt tray provides a convenient way for discharging the swept materials after cleaning a surface. The user does not need to change the gripping position but just keep a grasp on the handle and step on the dirt tray release button for detaching the dirt tray once the cleaning is finished, and no large body movement is required during the dirt tray detaching process when compared with other domestic sweepers.

In order to lock the dirt tray inside the housing of the sweeper, it is preferred that at least one lock means exists between the housing and the detachable dirt tray. Preferably, two lock means are applied on the present invention. A lock means which can be positioned in the front of the dirt tray consists of a front lock ridge that exists on the housing and a front lock groove that exists on the dirt tray. The other lock means which can be located behind the dirt tray comprises a rear lock ridge that exists on the housing and a rear lock groove that exists on the dirt tray. The arrangement of these two lock means ensure a balanced locking force between the housing and the dirt tray and ensure that the dirt tray is firmly attached to the housing during operation. When the dirt tray release button is pressed, the front lock ridge and the rear lock ridge will move away from the front lock groove and rear lock groove respectively. As a result, the two lock ridges no longer lock the dirt tray and therefore the dirt tray can be detached from the housing. Both of the front lock ridge and rear lock ridge cooperate with a return element so that these two ridges will return to locking positions if the dirt tray release button is not pressed.

When the dirt tray is reloaded into the housing of the sweeper, the dirt tray front wall and dirt tray rear wall will contact with the inclined surfaces that existed on the two lock ridges, and then force these two lock ridges to move away from their locking positions. The two lock ridges will then fit with the front lock groove and the rear lock groove once the dirt tray has completed reloading into the housing.

During discharging of the swept materials which accumulate inside the dirt tray, users of most domestic sweepers may need to turn the dust container upside down to remove the dust. In order to further reduce the chance for the dust and debris spread on the hand of the user it is preferred that at least one wall on the box-shape like dirt tray is openable for removal of the swept dust and debris accumulated inside the dirt tray compartment. The openable wall is preferred to be activated by a means which is preferably located away from the dirt tray. In the present invention, a button can be located on the lower handle at least 50 mm away from the dirt tray for opening the openable wall. The openable wall is located on the bottom of the dirt tray for the dust removal purpose, and it hangs on the front side of the dirt tray and opened on the rear side for discharging dust.

In a preferred embodiment, the openable wall on the bottom of the dirt tray can be closed when reloading the dirt tray into the housing. Since the openable wall hangs on the dirt tray at the front edge, during reloading of the dirt tray into the housing, the rear edge of the opened wall will first collide with the bottom surface inside the sweeper housing. When the dirt tray keeps on reloading to the housing, the opened wall located at the bottom of the dirt tray will be forced to pivot along the front edge towards the dirt tray compartment, as a result, the wall can be closed when the dirt tray is completely reloaded into the sweeper housing. The openable wall can also be closed by another means. Since the openable wall is positioned at the bottom of the dirt tray, user can hold the handle vertically with the bottom of the dirt tray face to the floor. Then the user can exert a downward force on the dirt tray so that the openable wall contacts with the floor, and this force is exerted until the openable wall is completely closed. Then the user can reload the dirt tray into the sweeper housing for next operation.

In an alternative embodiment, the openable wall can be located on the side of the dirt tray. The openable wall will remain closed when the slide button has not been pushed. After detaching the dirt tray from the housing, the user can push the slide button in order to open the openable wall that located on the side of the dirt tray and as a result, the dust and debris accumulated inside the dirt tray can be discharged.

It is noted that in the present invention the hands of the user do not need to directly contact with the dirt tray during the processes of dirt tray detachment, dust removal, and dirt tray reloading. In this preferred embodiment the chance for the dust and debris to be spread on the hands of the user is much reduced, and therefore, the hygienic problem that existed in most domestic sweepers can be improved.

BRIEF DESCRIPTION OF THE DRAWINGS

A specific embodiment of the present invention is now described, by way of example only, with reference to the accompanying drawings, in which.

DETAILED DESCRIPTION OF THE DRAWINGS

Figure 1:
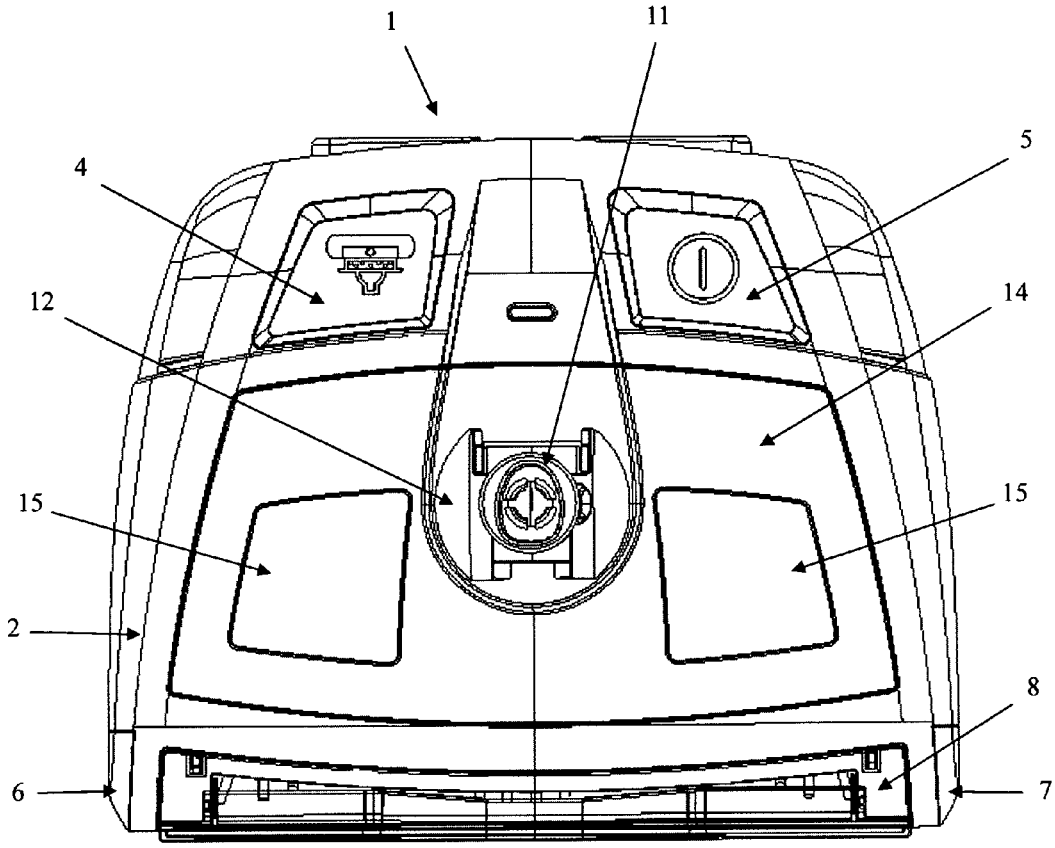
FIG. 1 is a plan view of the sweeping machine.

As shown in FIGS. 1 to 7, the electric cleaning sweeper 1 comprises an upper housing 2 and a lower housing 3. Within the appliance 1, a dirt tray 16 is adjacent to a brush bar 9 which extends transversally across the front compartment 64 of the sweeper. The brush bar 9 and a motor 30 are connected by a brush bar toothed roller 33, a toothed belt 32, and a motor toothed roller 31 in order to transmit the mechanical power from the motor 30 to the brush bar 9 such that the brush bar 9 rotates in an operating direction 65. The brush bar 9 rotates in the operating direction 65 in order to clean the surface by sweeping dust, debris or the like into the dirt tray compartment 18. The motor 30 is powered by electricity, which can be supplied by mains power supply, battery cells, or the like. In a preferred embodiment, a rechargeable battery pack 44 is used as the energy source for the appliance 1 because it can provide a high mobility during the operation. This rechargeable battery 44 transfers the electrical energy to the motor 30 to perform mechanical motion.

Figure 2:
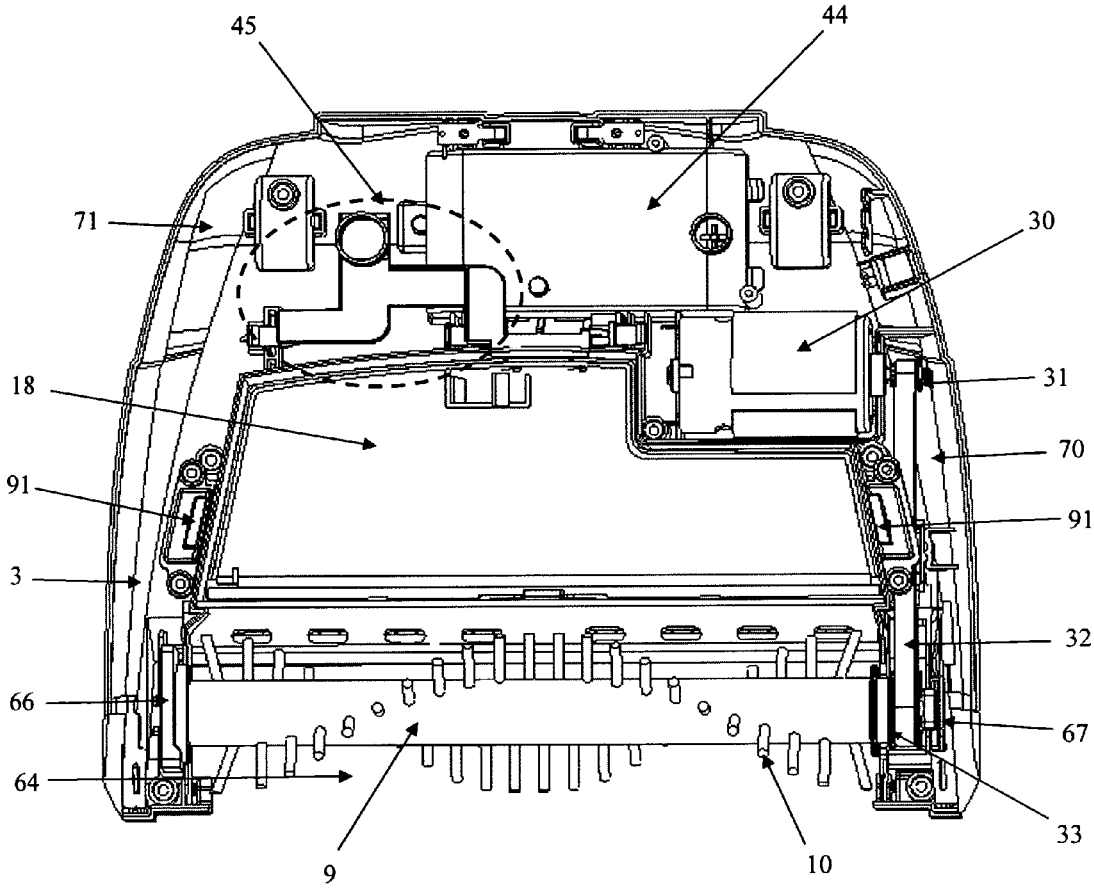
FIG. 2 shows a top view of the sweeping machine shown in FIG. 1, the internal structure and the positions of motor and brush bar are indicated.
Figure 4:
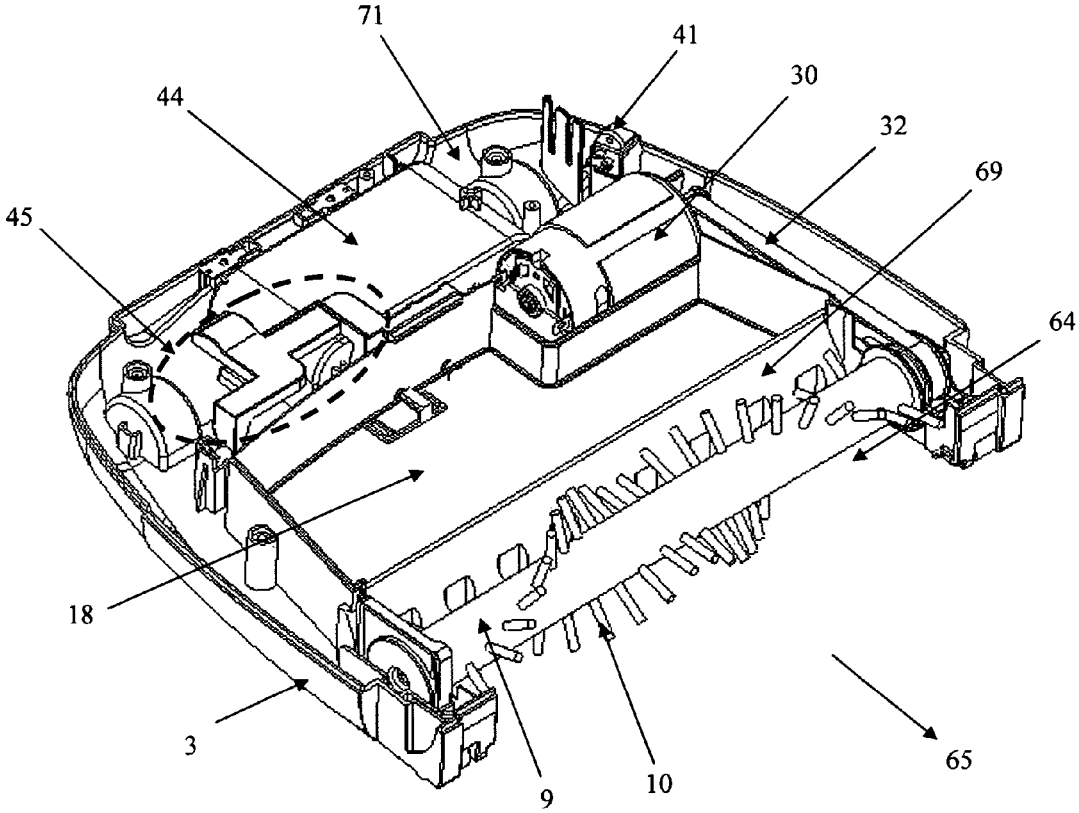
FIG. 4 is another elevation view of the embodiment shown in FIG. 3.

As shown in FIGS. 2 and 4, the front compartment 64 of the appliance 1 is mainly occupied by the brush bar 9. The brush bar 9 extends transversally across the front component 64 until the ends of the brush bar have reached the right brush bar support 66 and left brush bar support 67 which located on the lateral side of the front compartment 64.

Figure 7:
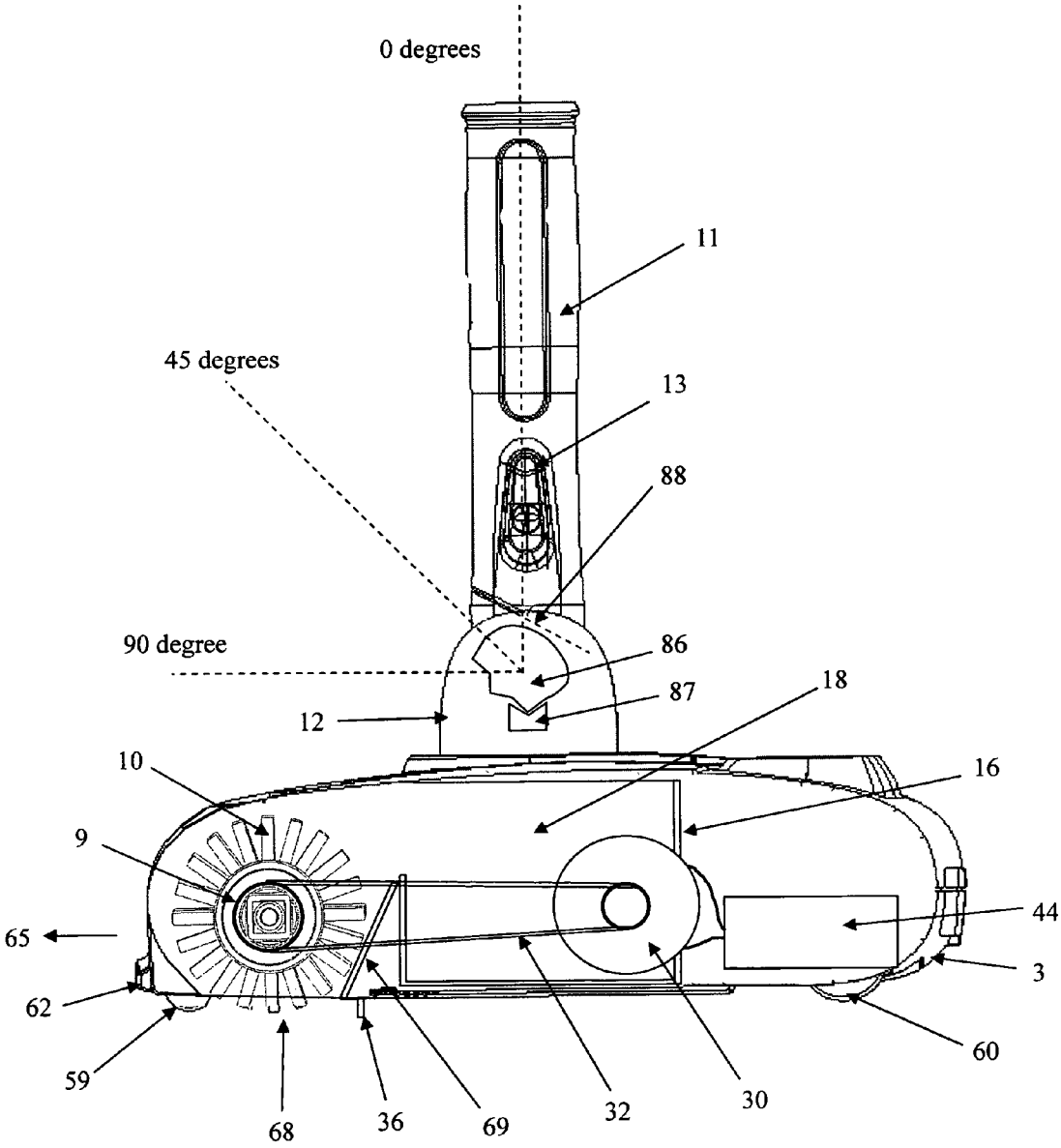
FIG. 7 is a side view of the sweeping machine, the positions of the motor, brush bar and dirt tray are indicated.

As shown in FIG. 7, the lower housing 3 has a brush bar opening 68 beneath the brush bar 9 that allows the bristles 10 to contact with the surface being cleaned, such as floor, carpet or the like. The area of the brush bar opening 68 is large enough to provide the most effective sweeping area for the brush bar 9.

Figure 3:
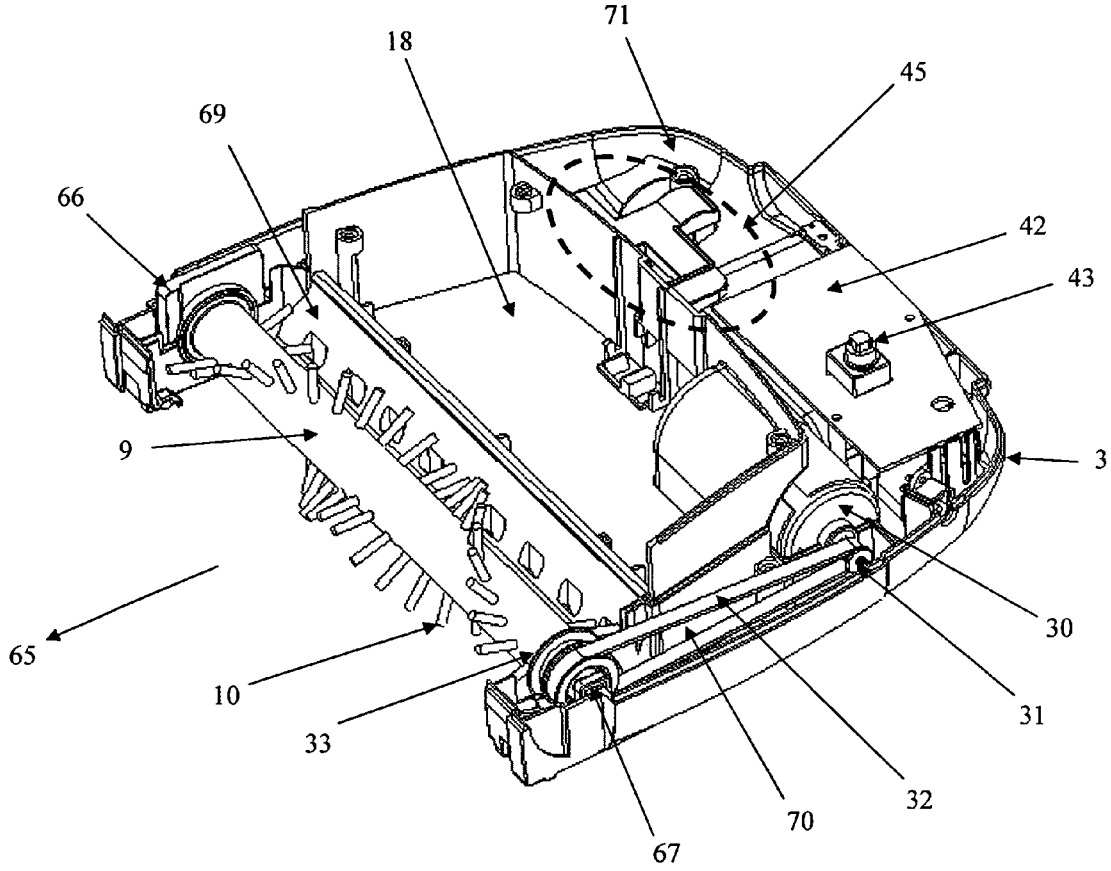
FIG. 3 is an elevation view, partly in perspective, of the sweeping machine shown in FIG. 2.

FIGS. 3, 4, and 7 show that the inclined wall 69 adjacent to the brush bar 9 allows the dust or debris be propelled into the dirt tray 16 when the brush bar 9 is rotating. Dust or debris can pass through the inclined wall 69 and then get into the dirt tray compartment 18. The inclined wall 69 inclines away from the brush bar 9 and projects upwardly until the height is about the same as the location of the brush bar 9.

FIGS. 2, 4, and 7 show the basic working principle of the appliance 1. The rechargeable battery 44 which is located behind the dirt tray 16 supplies electricity to the motor 30. When the rechargeable battery 44 is used up, it can be recharged by connecting a plug between the mains supply and a socket 41 which located on the housing. Alternatively, the rechargeable battery 44 can also be charged by placing the appliance 1 on a charger, then connect a plug between the charger and the main supply. The motor 30 drives the toothed belt 32, and the toothed belt 32 drive the brush bar 9 to rotate. Bristles 10 on the brush bar 9 contact the surface to be swept through the brush bar opening 68 for sweeping the debris and dust into the dirt tray compartment 18.

FIGS. 2 and 3 show that a toothed belt space 70 is allocated inside the appliance 1 to accommodate the power transmission mechanism which consists of the motor toothed roller 31, the brush bar toothed roller 33 and the toothed belt 32. The motor toothed roller 31 that is mounted on the motor 30 cooperates with the toothed belt 32, and the toothed belt 32 extends through the toothed belt space 70 and cooperates with brush bar toothed roller 33 that mounted on one side of the brush bar 9.

FIG. 3 shows that a PCB assembly 42 which located at the rear compartment 71 of the appliance 1 connects with a power switch 43. The PCB assembly 42 provides the logical algorithm for operating the sweeper. With the logical algorithm, user can press or step on the power switch button 5 which located on the upper housing 2 to switch on or switch off the appliance 1. The switch button 5 cooperates with the power switch 43 for controlling the status of discharge of the rechargeable battery 44.

Figure 14:
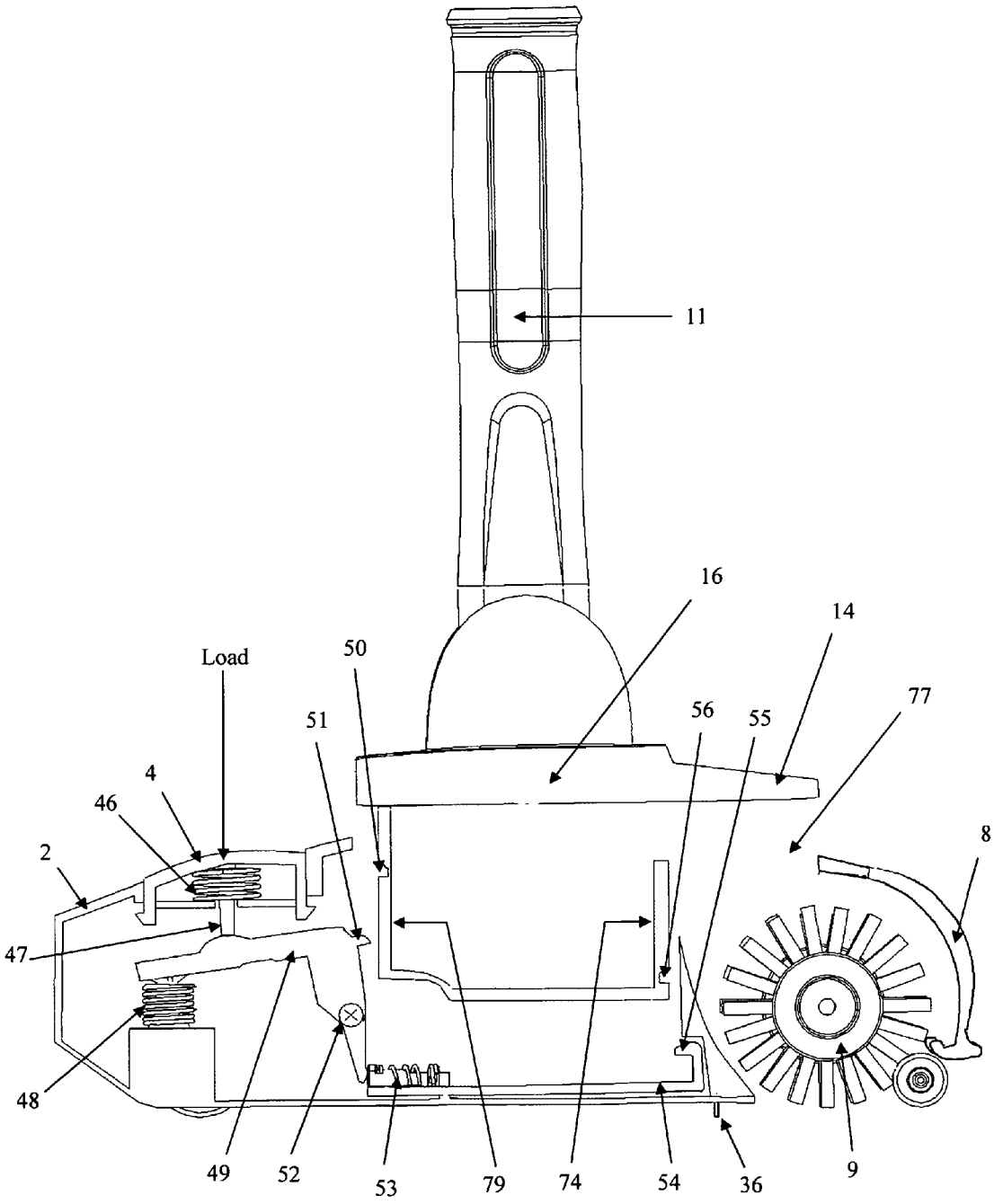
FIG. 14 is a view similar to FIG. 13 illustrating the mechanism of the dirt tray lock which is unlocking the dirt tray.

In FIG. 14, it is shown that the upper housing 2 has means forming a housing middle opening 77 therein, and that the dirt tray 16 can be detached away from the sweeper perpendicularly outwardly to the top surface of the upper housing 2 by pressing the dirt tray release button 4 which is located on the upper housing 2. The dirt tray 16 can be reloaded into the housing middle opening 77 again for the next operation.

Figure 9:
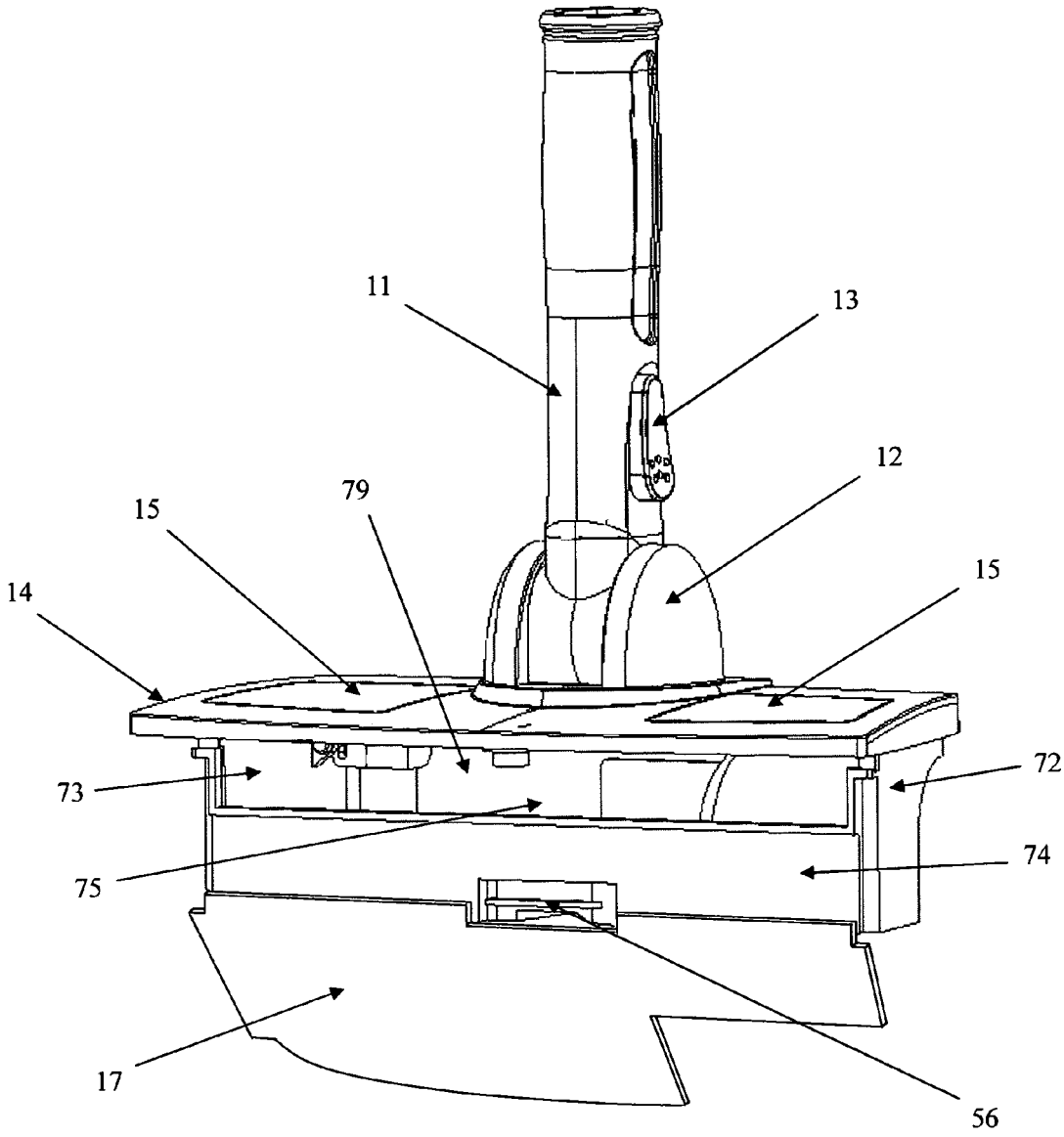
FIG. 9 shows a perspective view of the dirt tray used in the sweeping machine with bottom wall opened.
Figure 13:
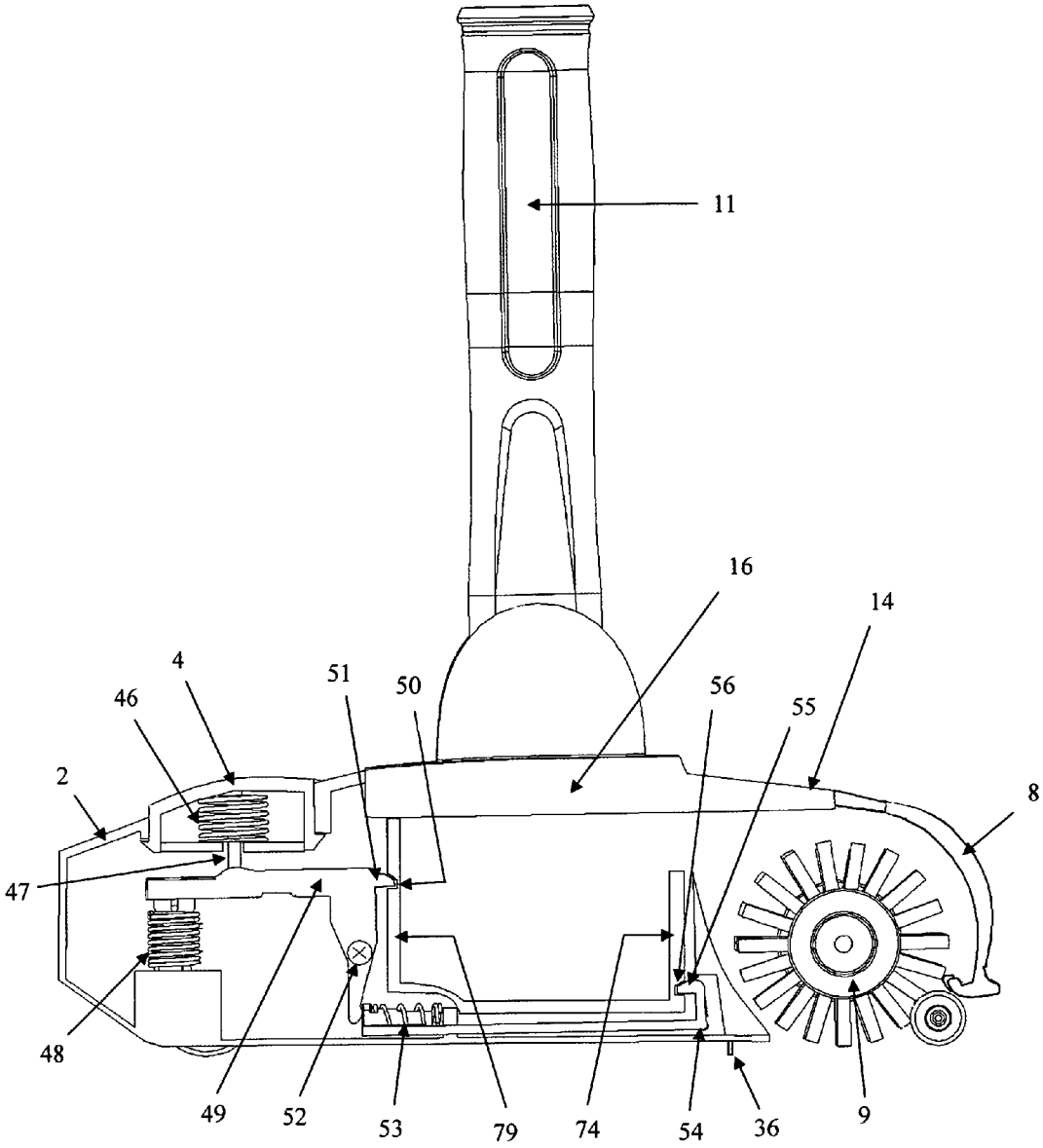
FIG. 13 is a view illustrating the mechanism of the dirt tray lock which is locking the dirt tray.

As shown in FIGS. 9 and 13, the dirt tray 16 has a top cover 14 which includes at least one clear window 15. The top cover 14 is angled to match the angle of the top surface of the upper housing 2 and forms a portion of the surface of the upper housing 2 when the dirt tray 16 is attached to the sweeper. The dirt tray 16 connects with the lower handle 11 by a pivot joint 12. The pivot joint 12 becomes a connection point between the housing and the lower handle 11 when the dirt try 16 is attached into the housing. With this connection, a user can operate the appliance 1 by gripping the lower handle 11 or gripping an upper handle 63 when an extendable pipe 61 is equipped. The pivot joint 12 provides a high maneuverability which benefits use of the appliance 1 in different cleaning conditions.

FIG. 13 shows the cross sectional view of the embodiment of the dirt tray lock mechanism 45 inside the appliance 1. In a preferred embodiment, the dirt tray lock mechanism 45 composes a dirt tray release button 4, a button return element 46, a rear lock lever 49, a lever return element 48, a front lock bar 54, and a bar return element 53. A pin 47 is extended from the dirt tray release button 4. Under the dirt tray release button 4 is a button return element 46, with a preferred embodiment of the button return element being a spring. The rear lock lever 49 is attached on a hinge 52 so that it can move pivotally, wherein below the rear part of the rear lock lever 49 is a lever return element 48 in a means of spring. The lower part of the rear lock lever 49 is extended to contact with the rear end of the front lock bar 54 and the bar return element 53. The bar return element 53 is designed in a means of spring so that the front lock bar 54 can move rearward when the rear lock lever 49 is not pushing the front lock bar 54. The rear lock lever 49 has a rear lock ridge 51 and the front lock bar 54 has a front lock ridge 55 respectively. The rear lock ridge 51 and front lock ridge 55 cooperate with a rear lock groove 50 and a front lock groove 56 respectively, wherein the rear lock groove 50 existed on the dirt tray rear wall 79, and the front lock groove 56 existed on tine dirt tray front wall 74. As a result, the dirt tray 16 can be locked in the appliance 1.

FIG. 14 presents an illustrative expression of the dirt tray lock mechanism under the condition that a load is exerted on the dirt tray release button 4. In the figure, it is shown that when a load is applied to the dirt tray release button 4, the pin 47 descends one end of the rear lock lever 49 and makes it pivots along the hinge 52. As the rear lock lever 49 pivots backwardly, the rear lock ridge 51 moves away from the rear lock groove 50. The rear lock lever 49 also pushes the front lock bar 54 forwardly, such that the front lock ridge 55 moves away from the front lock groove 56 as illustrated. At that time, the rear lock ridge 51 and front lock ridge 55 are no longer detaining the rear lock groove 50 and front lock groove 56 respectively, as a result, the dirt tray 16 is unlocked. In FIG. 2, it is shown that there are two dirt tray return elements 91. They are located on the housing of the sweeper and positioned beside the dirt tray compartment 18. With these two dirt tray return elements 91, the dirt tray will be pushed to move slightly away from the housing once the dirt tray 16 has been unlocked and therefore give a visual signal to the user to notice that the dirt tray 16 is able to be detached.

As shown in FIG. 13, when the load is not applied on the dirt tray release button 4, the button return element 46 extends and the dirt tray release button 4 is pushed back to the original position for the next detachment of the dirt tray 16. At the same time, the lever return element 48 and the bar return element 53 extend such that the rear lock lever 49 and the front lock bar 54 return to their original positions.

When the dirt tray 16 is reloading into the housing, the dirt tray front wall 74 and dirt tray rear wall 79 will contact with the inclined surface on the front lock ridge 55 and rear lock ridge 51 respectively. The dirt tray front wall 74 collides with the inclined surface of front lock ridge 55 and then forces the front lock bar 54 to move forwardly, at the same time, the dirt tray rear wall 79 collides with the inclined surface of rear lock ridge 51 and therefore forces the rear lock lever 49 to pivot backwardly. When the dirt tray 16 keeps on reloading into the housing, the front lock ridge 55 and rear lock ridge 51 will fit with the front lock groove 56 and the rear lock groove 50 respectively. Then the lever return element 48 and the bar return element 53 extend, as a result, the dirt tray 16 is lock in the housing.

By studying FIG. 14, it is realized that when a load is exerted on the dirt tray release button 4 by means of foot or the like, the rear lock lever 49 and front lock bar 54 will be positioned in the unlocking positions so that the user can detach the dirt tray 16 from the sweeper without touching the dirt tray surface. This has not been possible with the known dirt trays in domestic sweepers.

Figure 10:
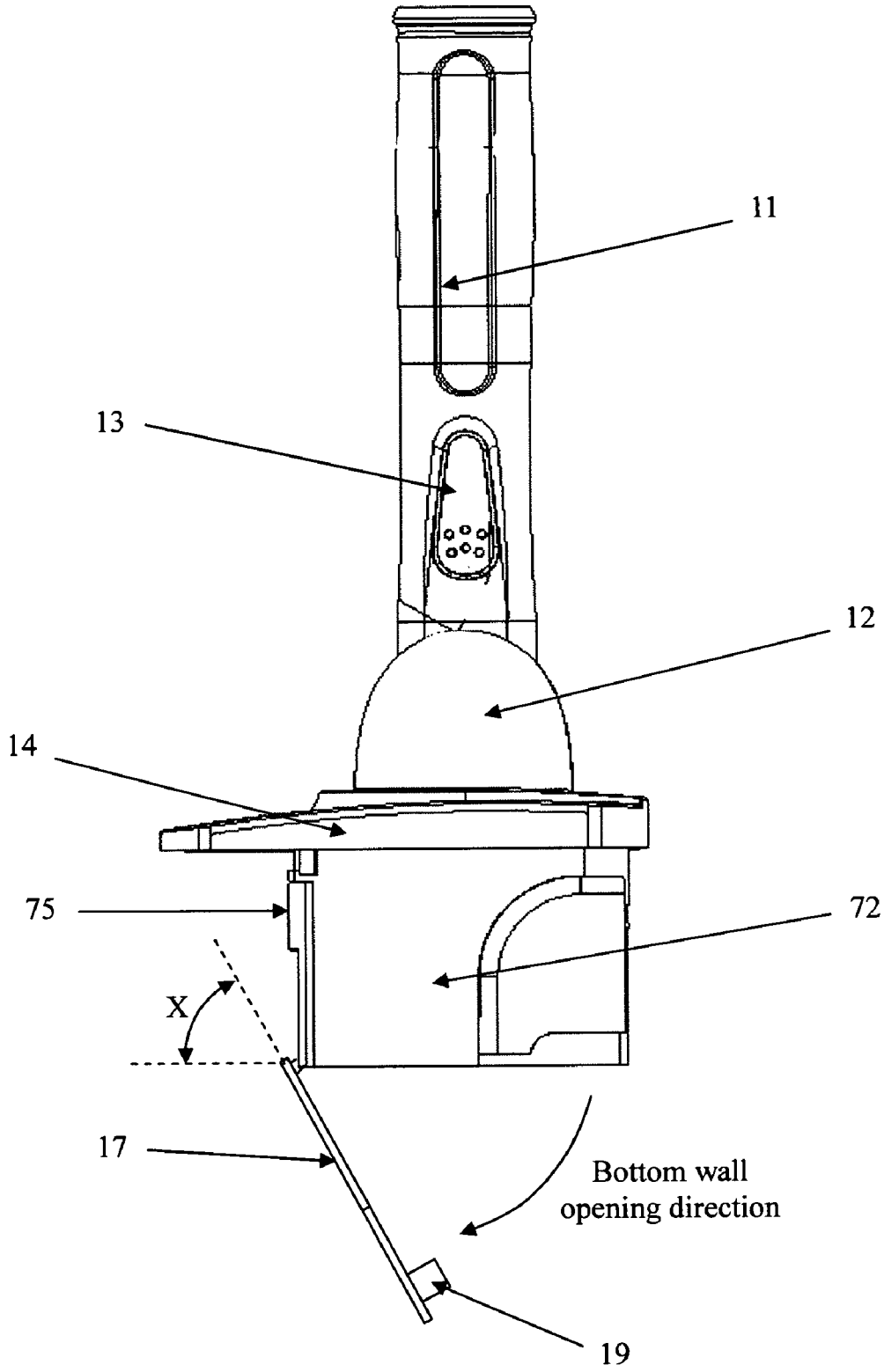
FIG. 10 shows a side view of the dirt tray shown in FIG. 9 with bottom wall opened.

Referring to FIGS. 9 and 10, an exemplary embodiment of the dirt tray 16 is shown. The dirt tray 16 comprises a top cover 14 which is connected with the lower handle 11 by a pivot joint 12, a bottom wall 17, two dirt tray side walls 72 and 73, a dirt tray front wall 74 and a dirt tray rear wall 79. With the walls 17, 72, 73, 74 and 79, the dirt tray 16 forms a box-like shape with a dirt tray compartment 18. The dirt tray compartment 18 accommodates the collected dust, debris or the like. A dust inlet opening 75 exists above the dirt tray front wall 74 of dirt tray 16 so that dust and debris which swept by the brush bar 9 is allowed to enter the dirt tray compartment 18. The upper edge of the dirt tray front wall 74 is made high enough to prevent spilling of the swept materials and provides sufficient space for the inlet opening 75. A plurality of walls on the dirt tray 16 can greatly reduce the chance of dirt leakage when operating the appliance 1 or during detaching the dirt tray 16.

In most traditional sweeper designs, the user is required to directly detach the dirt tray by hand for discharging the collected dust, therefore, the dirt may engulf the user. In this invention, the user does not need to directly touch the dirt tray 16 by their hands when taking out the dirt tray 16. As shown in FIGS. 9 and 10, a user only needs to grip the lower handle 11 and push a button which is at least 50 mm away from the dirt tray surface, and the bottom wall 17 will then be opened for emptying the dust and debris. This embodiment provides a cleaner dirt tray cleaning process than previous designs. The opening angle X of the bottom wall 17 is in a range of 60 degrees to 80 degrees in order to provide sufficient space for the dust to be removed. If the angle X is too small, there is a difficulty to remove the swept materials because the outlet is too narrow. If the angle X is too large, there is a difficulty in reloading the dirt tray 16 into the housing and it is difficult to close the bottom wall 17, furthermore, the swept materials may spread everywhere because of the large movement of the bottom wall 17. In a preferred embodiment, the bottom wall 17 is opened at about 70 degrees.

Figure 11:
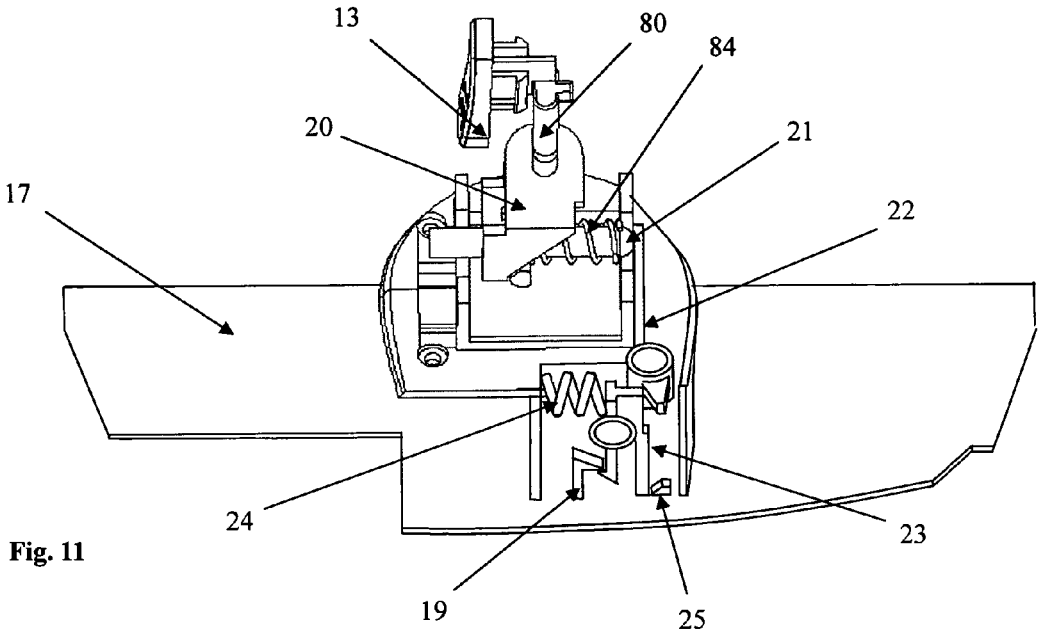
FIG. 11 is a view illustrating the locking mechanism of the bottom wall with internal components positioned in a locking condition.
Figure 12:
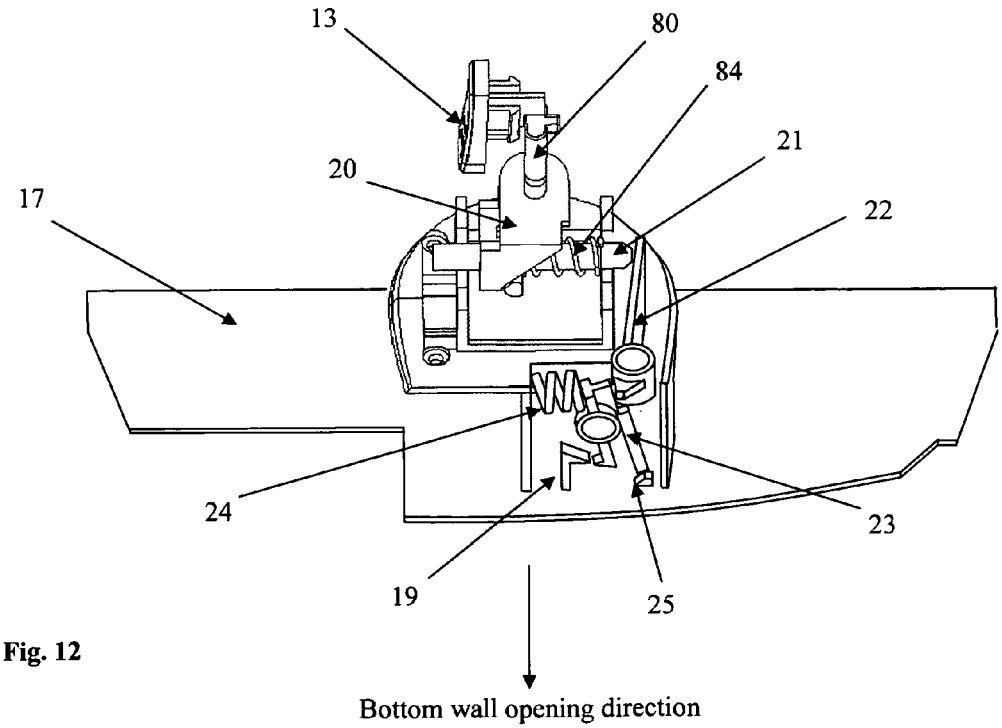
FIG. 12 is a view illustrating the locking mechanism of the bottom wall with internal components positioned in an unlocking condition.

FIGS. 11 and 12 shows an embodiment of the openable dirt tray door mechanism. The mechanism composes a slide button 13, a slide bar bracket 20, a slide bar 21, a bar return element 84, a pivot lever 22, a hook lever 23, a lever return element 24, and a bottom wall 17. The slide bar bracket 20 consists of a slide button bar 80 extended from the bracket upper surface to contact with the slide button 13. In order to lock the bottom wall 17 with the dirt tray 16 to form a box-shaped like dirt tray compartment 18, the rear part of the bottom wall 17 has a hook 19 projected from the inner surface of the door, such that the hook 19 engages with the edge of the hook lever 23.

The bottom wall 17 can only be opened when the dirt tray 16 is not attached to the housing. As shown in FIG. 11, when a load is not applied to the slide button 13, the bar return element 84 and the lever return element 24 extend to keep the position of the hook lever 23 in the locking position. The hook lever 23 engages with the hook 19 such that the bottom wall 17 is closed.

As shown in FIG. 12, a user can open the bottom wall 17 by applying a load on the slide button 13, the slide button bar 80 pushes the slide bar bracket 20, then the slide bar bracket 20 compresses the bar return element 84 and the slide bar 21, thus, the slide bar 21 forces the pivot lever 22 pivots and forces the hook lever 23 pivots as well. The pivotal movement of the hook lever 23 allows the edge of hook lever 23 moves away from the hook 19, and the hook lever 23 push the guiding ridge 25 to slightly give a pushing force on the bottom wall 17 for assisting the opening of the bottom wall 17. As a result, the bottom wall 17 can then be opened due to gravitational force.

The user can close the bottom wall 17 after the dirt tray 16 has been emptied or cleaned. In a preferred embodiment, the bottom wall 17 can be closed by reloading the dirt tray 16 into the housing. Since the bottom wall 17 hangs on the dirt tray 16 at the front edge, during reloading the dirt tray 16 into the housing, the rear edge of the bottom wall 17 will first collide with the bottom surface inside the sweeper housing. When the dirt tray 16 keeps on reloading into the housing, the opened wall 17 located at the bottom of the dirt tray 16 will be forced to pivot along the front edge and move toward the dirt tray compartment 18, as a result, the inclined surface of the hook 19 collide with the inclined surface of the edge on hook lever 23. When the hook 19 forces the hook lever 23 to pivot, the lever return element 24 will be compressed until the hook 19 can engage with the hook lever 23 in order to lock the bottom wall 17 in a closed position.

The bottom wall 17 can also be closed by another means. Since the bottom wall 17 is positioned at the bottom of the dirt tray 16, the user can hold the lower handle 11, or hold the upper handle 63 if the extendable pipe 61 is provided, vertically with the bottom of the dirt tray 16 faced to the floor. Then the user can exert a downward force on the dirt tray 16 so that the bottom wall 17 contacts the floor, and this force is gently exerted until the bottom wall 17 is completely closed. Then the user can reload the dirt tray 16 into the sweeper housing for next operation.

Figure 15:
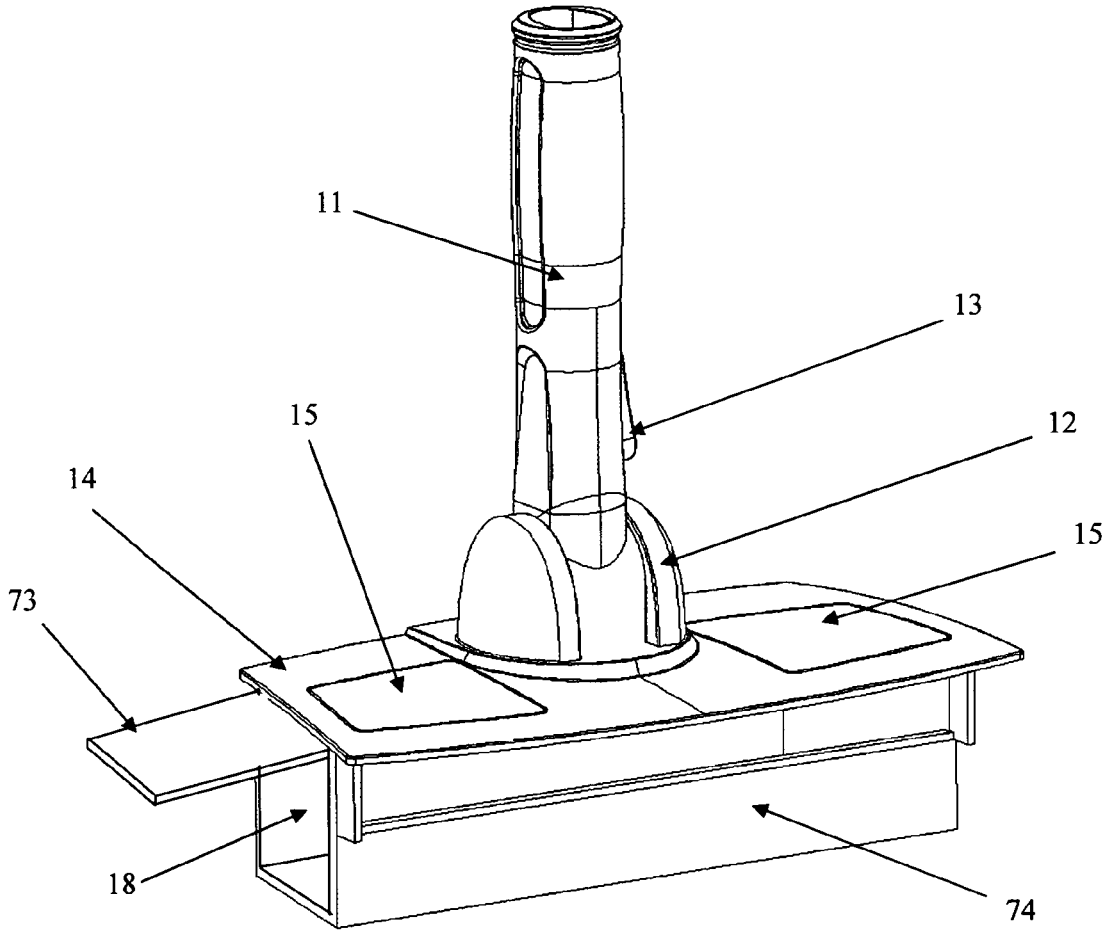
FIG. 15 is a perspective view of the dirt tray with a dirt tray side wall design.

FIG. 15 shows another embodiment of the dirt tray door. In this embodiment, at least one openable side wall 73 on the dirt tray 16 allows the discharge of dirt from the dirt tray compartment 18. The motion of the side wall 73 is controlled by a slide button 13 which located at one side of the lower handle 11.

Figure 16:
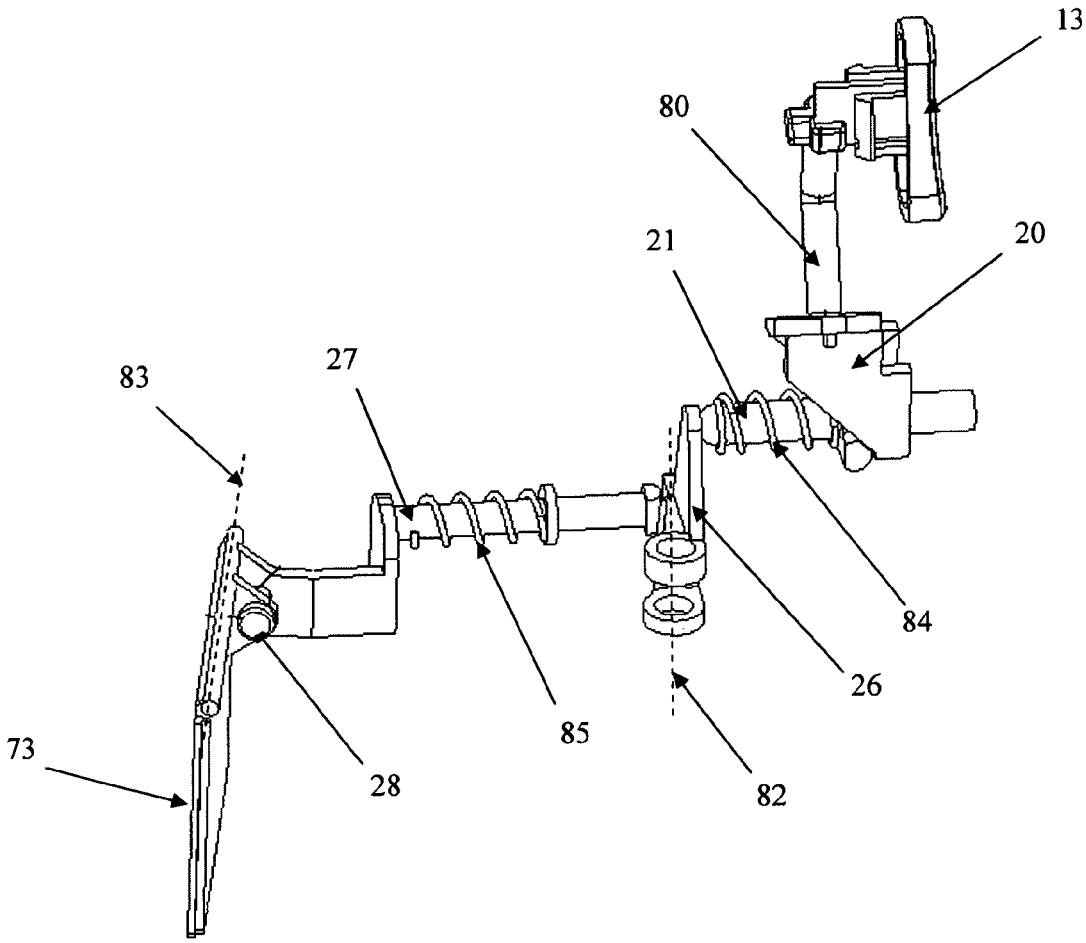
FIG. 16 is a view illustrating the mechanism of the dirt tray side wall bock which shown in FIG. 15.

FIG. 16 illustrates the mechanism of the side wall 73. When the slide button 13 is pushed, the slide button 13 then pushes the slide button bar 80 to press slide bar bracket 20. The slide bar bracket 20 has an inclined surface such that the inclined surface presses slide bar 21 and therefore forces slide bar 21 moves horizontally toward a middle lever 26. The slide bar 21 then pushes the middle lever 26 to pivot about a lever axis 82 and presses a side wall bar 27 to move horizontally toward the side wall 73. The side wall bar 27 connects with the side wall 73 by a side wall pin 28. When side wall bar 27 moves horizontally toward the side wall 73, the side wall 73 pivots about the side wall axis 83 and, as a result, the side wall 73 is opened upwardly and outwardly, and then the dust inside the dirt tray compartment 18 can be removed. After emptying the dirt tray 16, the user releases the slide button 13 and as a result a bar return element 84 pushes the slide bar 21 to move horizontally away from the middle lever 26. Another bar return element 85 then pushes the side wall bar 27 to move horizontally away from the side wall 73. Since the side wall bar 27 connects side wall 73 by the side wall pin 28, the side wall 73 will be closed by pivoting about the side wall axis 83 downwardly inwardly. At that time, the dirt tray 16 can be reloaded into the sweeper and ready for next sweeping operation.

As illustrated in FIGS. 9 and 10, the lower handle 11 is pivotally connected with the top cover 14. At least one top portion of the top cover 14 is made of a clear material that allows the user to ascertain the contents in the dirt tray compartment 18 and to know if the debris collected is reaching the dirt tray compartment 18. In one alternative embodiment two clear windows 15 are used, at the left top portion and right top portion on the lop cover 14.

FIG. 7 shows that a clamping mechanism is constructed inside the pivot joint 12 which allows the lower handle 11 to be locked at different predetermined angles. A ledge 86 and a slot 87 exist inside the pivot joint 12. The lower handle 11 can pivot forwardly to the operating direction 65 and pivot backwardly so that it is opposite to the operating direction 65. The lower handle 11 can be clamped at 0 degree, which is perpendicular to the upper surface of the appliance 1; at 45 degree, wherein the lower handle 11 is pivoted 45 degrees forwardly; and at 90 degrees, wherein the lower handle 11 is pivoted 90 degrees forwardly and parallel to the operating direction 65.

Figure 8:
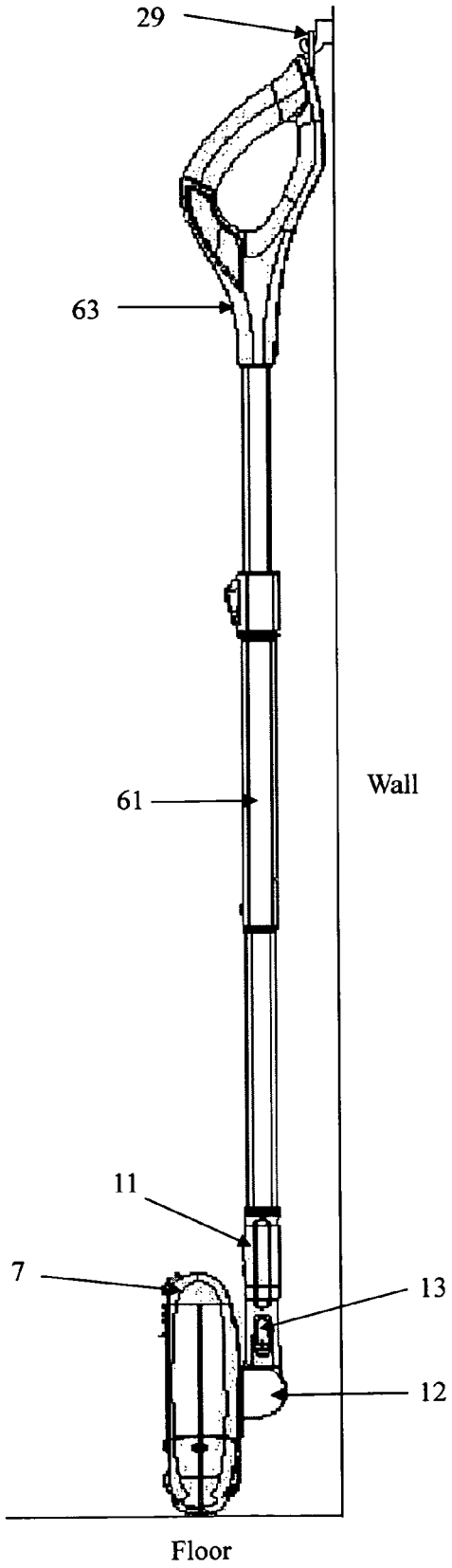
FIG. 8 shows a side view of the sweeping machine with an extendable handle.

FIG. 8 shows the sweeper in a storage position. In the figure, the appliance 1 is equipped with the extendable pipe 61 and the handle is clamped at a position which is pivoted 90 degrees forwardly. A mounting ring 29 is positioned on the upper handle 63 and cooperates with a hook which fixed on a wall. With this mounting ring 29, the sweeper can be prevented from falling down on the floor due to an accidental strike on the appliance 1 and therefore the appliance 1 can be stored against a wall stably. In another embodiment, the appliance 1 can also be stored on the floor when the handle is clamped at the upright position, which is at 0 degree.

FIG. 7 also shows that a swivel joint 88 is constructed inside the lower handle 11 which allows the lower handle 11 to be swivelable. When the lower handle 11 pivots forwardly, the lower handle 11 is not able to swivel. Only when the lower handle 11 has been pivoted backwardly, the lower handle 11 is free to swivel. Since the swivel joint 88 has an inclined surface, therefore a steering action can be easily achieved when swiveling the lower handle 11, or swiveling the upper handle 63 if extendable pipe 61 is equipped. This swivel joint 88 further increases the maneuverability of the appliance 1 in different cleaning tasks.

Figure 6:
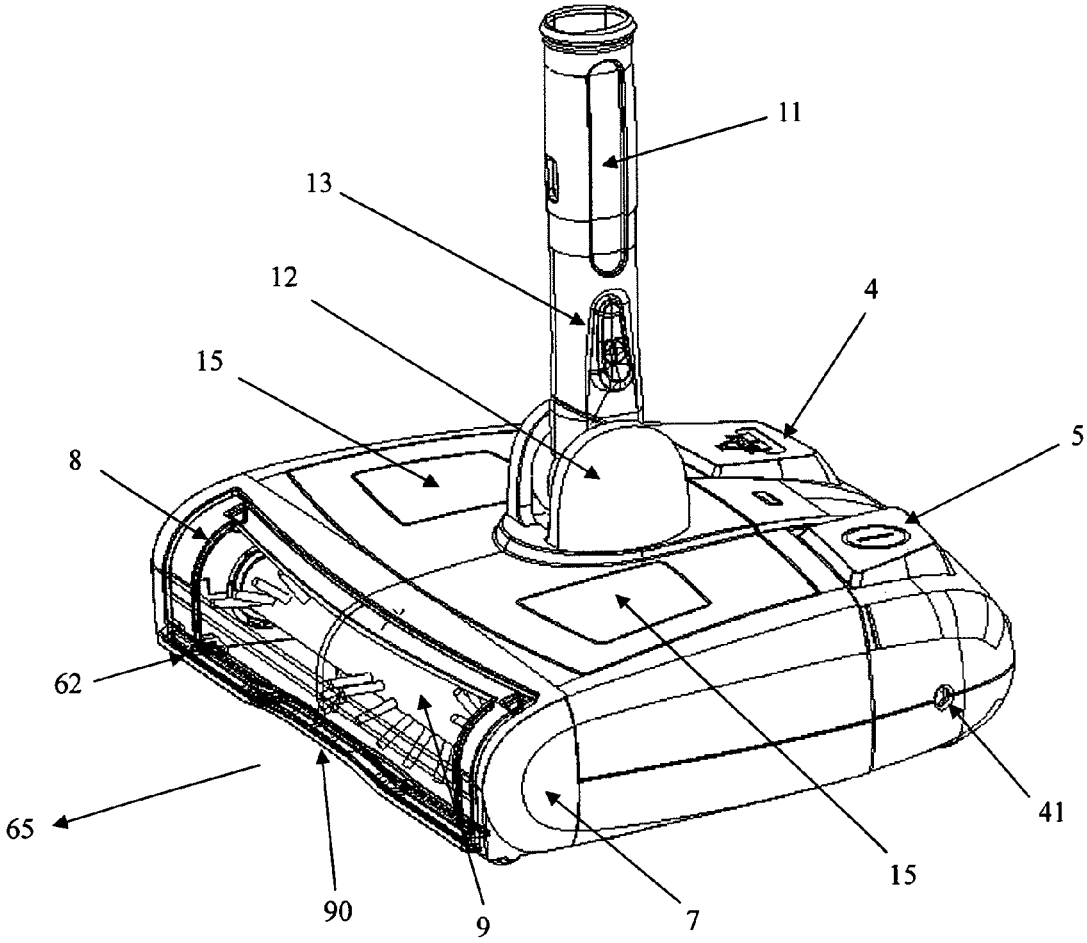
FIG. 6 is a perspective view of the sweeping machine.

As shown in FIG. 6, a front cover 8 is positioned in the front part of the sweeper to prevent the user from touching the brush bar 9. The front cover 8 is preferably made of transparent material so that the user is able to observe the operation of the brush bar 9. The front cover 8 is locked with the upper housing 2 and the lower housing 3, and it is removable such that the brush bar 9 can be exposed. A rounded notch 90 is provided on the front cover 8 for facilitating the removal of the front cover 8. The rounded notch 90 indicates the position for the user to grasp the front cover 8 and the user can then grasp and pull out the front cover 8. A front cover bumper 62 is positioned on the front edge of the front cover 8 to provide protection for the furniture and the sweeper itself.

Referring to FIG. 1, right bumper 6 and left bumper 7 on the lateral sides of the sweeper can provide protection for the furniture and the sweeper itself. Also, it can protect the sweeper from external forces exerted on the unit that can scratch on the surface of the sweeper. In most cases, the user drives the sweeper forwardly, and the right bumper 6 and left bumper 7 on the outer side of front compartment 64 can protect the unit and furniture from scratching the surface.

Figure 5:
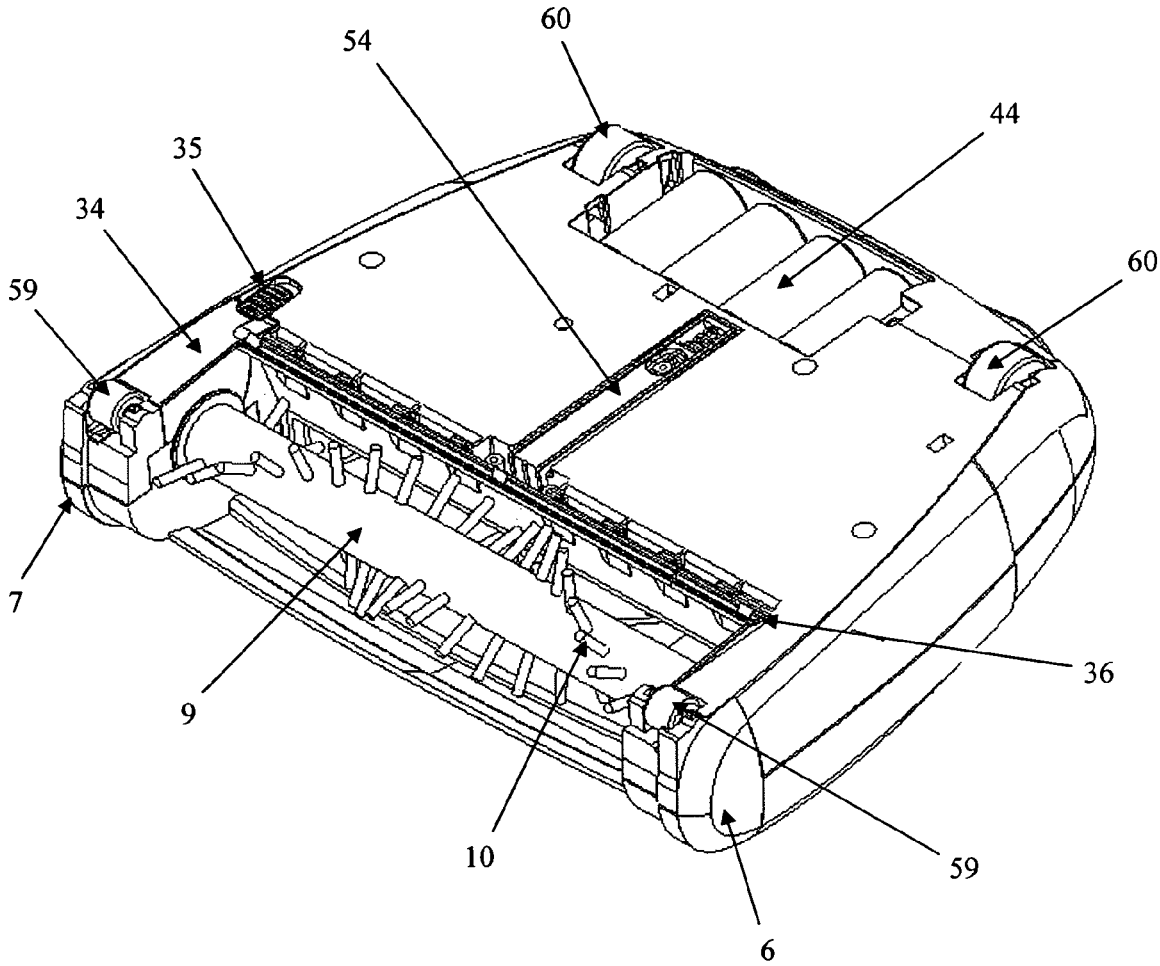
FIG. 5 is an underside view of the sweeping machine.

In FIG. 5, it is indicated that a pair of front wheels 59 and a pair of rear wheels 60 are positioned at the lower surface of the lower housing 3 in order to support the whole appliance 1 and allow the appliance 1 moves smoothly on a cleaning surface. As shown in FIG. 5, the front wheels 59 and the rear wheels 60 are located at the lateral side of the front compartment 64 and the rear compartment 71 respectively.

FIGS. 7, 13, and 14 show that a squeegee 36 is located at the bottom surface of the sweeper behind the brush bar opening 68. During a normal operation, the sweeper moves forward and sweeps the dust and debris into the dirt tray compartment 18, however, some dust may not be successfully swept and therefore remain on the cleaning surface. The squeegee 36 which is preferably made of soft materials, for example rubber, then wipes against the cleaning surface and confines the remaining dust behind the brush bar 9 so that this remaining dust can be swept in the following sweeps. The squeegee 36 also prevents the dust or debris being bounced under the appliance 1. As the brush bar 9 rotates and sweeps the dust into the dirt tray compartment 18, some particles may not be swept into the dirt tray compartment 18 but may be swept and bounced under the appliance 1. The squeegee 36 then can block the gap between the lower surface of lower housing 3 and the cleaning surface, therefore prevent the dust being swept and bounced under the appliance 1.

As shown in FIG. 5, the lower surface of the lower housing 3 consists of at least one brush bar cover 34 which allows the user to clean or remove the brush bar 9 from the front compartment 64. The brush bar cover located beside the brush bar opening 68, and is locked by the brush bar cover lock 35.

What is claimed is:

1. An electric sweeper for sweeping and collecting particles of dust and debris on a surface to be cleaned, comprising:

a handle;

a housing connected to the handle;

a rotating brush bar positioned at least partially within the housing to sweep particles of dust and debris;

a detachable dirt tray connected with the handle and receivable in the housing, which is responsive to movement of a device positioned on the housing for allowing the dirt tray to be detached from the housing; and wherein the dirt tray has at least one openable wall and means responsive to movement of a device positioned on the handle of the electric sweeper for controlling the position of the openable wall.

2. The electric sweeper according to claim 1, wherein the device for allowing the dirt tray to be detached is a button which positioned on the housing of the electric sweeper.

3. The electric sweeper according to claim 2, wherein the button can be pressed or stepped on for allowing the dirt tray to be detached.

4. The electric sweeper according to claim 1, wherein the dirt tray is detached from the housing of the sweeper by removing the handle in connection with the dirt tray from the housing.

5. The electric sweeper according to claim 1, wherein the device for controlling the position of the at least one openable wall is a button which positioned on the handle of the sweeper.

6. The electric sweeper according to claim 5, wherein the button is pushed or pressed to open the openable wall so as to discharge dust and debris.

7. The electric sweeper according to claim 1, wherein the at least one openable wall is located at the bottom of the dirt tray.

8. The electric sweeper according to claim 7, wherein the at least one openable wall is closed by applying an external force on the openable wall.

9. The electric sweeper according to claim 1, wherein an alternative for the at least one openable wall is located at the side of the dirt tray.

10. The electric sweeper according to claim 9, wherein the at least one openable wall on the dirt tray is self-closing.

11. The electric sweeper according to claim 1, wherein the dirt tray is connected with the handle by a pivot joint.

12. The electric sweeper according to claim 11, wherein the joint is a connection point between the housing of the sweeper and the handle during operation.

* * * * *